US006536726B1

(12) United States Patent
Tull

(10) Patent No.: US 6,536,726 B1
(45) Date of Patent: Mar. 25, 2003

(54) MOUNTING DEVICE FOR BOAT TOWER

(75) Inventor: R. Stevens Tull, P.O. Box 184, Ship Bottom, NJ (US) 08008

(73) Assignee: R. Stevens Tull, Barnegat, NJ (US)

( * ) Notice: Subject to any disclaimer, the term of this patent is extended or adjusted under 35 U.S.C. 154(b) by 0 days.

(21) Appl. No.: 09/475,503

(22) Filed: Dec. 30, 1999

(51) Int. Cl.[7] ..... A47B 91/00; F16M 11/20

(52) U.S. Cl. ..... 248/188.8; 248/500; 248/499; 248/276; 248/289.11; 248/403; 248/157; 248/79

(58) Field of Search ..... 248/276, 288.31, 248/298.1, 299.1, 279.1, 188.8, 278.1, 282.1, 289.11, 500, 499, 506; 403/157, 79, 13, 14

(56) References Cited

U.S. PATENT DOCUMENTS 4,872,630 A * 10/1989 Cooper ..... 248/278
4,887,784 A * 12/1989 Kayali ..... 248/311.2
5,092,552 A * 3/1992 Dayton et al. ..... 248/280.1
5,245,780 A * 9/1993 Hansen et al. ..... 43/27.4
5,248,176 A * 9/1993 Fredriksson ..... 294/1.1
5,329,871 A * 7/1994 Gibbs ..... 114/363
5,551,660 A * 9/1996 Leduchowski ..... 248/276.1
5,853,158 A * 12/1998 Riggle ..... 248/311.2
6,243,920 B1 * 6/2001 Sauve ..... 16/361

* cited by examiner

*Primary Examiner*—Kimberly Wood
(74) *Attorney, Agent, or Firm*—Mandel & Peslak, LLC; Arthur M. Peslak

(57) ABSTRACT

A device and method of attaching an above deck tower to a boat deck is described. The tower generally has a plurality of legs that extend down to the boat deck surface for mounting purposed. The device of the present invention comprises a fitting adapted to receive the legs of the tower and two mounting devices. The mounting devices and the fitting can all be rotated relative to each other so that the tower mounting points can all be uniformly oriented for easy installation and removal of the tower from the boat deck.

6 Claims, 5 Drawing Sheets

MOUNTING DEVICE FOR BOAT TOWER

BACKGROUND OF THE INVENTION

Various types of structures that are generally referred to as towers are in use on recreational and pleasure boats. The towers are typically fabricated from metal tubing or pipe. The towers form a structure over part of the deck surface of the boat. The tower is typically fastened to some part of the deck of the boat and extends upward from the deck surface. The towers are also known to those of ordinary skill in the art variously as arches, half towers, tuna towers, towers, hardtops, and hardtop support systems. The towers can be used to provide sunshade, shelter from the elements, mounting points for a variety of equipment for various purposes, and additional control stations.

The present invention is directed to a device for easily mounting, removing and replacing towers on the deck of almost any boat. In the prior methods and devices for attaching these structures to boat decks, the most common method is to utilize mating male and female fittings. Generally, in the prior methods, the female fitting is attached in some manner to the upper surface of the boat deck. The towers all have several legs that form the mounting points on the deck. In order to be able to place and withdraw the male component from the female component of the fitting, it is necessary for the female component of the fittings to all have the same directional orientation. One problem with creating the proper orientation is that the deck mounting surfaces on many boats is generally not flat but varies over its surface at some angle to the horizontal. Due to this variation in the deck surface, it is difficult to install the plurality of fittings with a uniform vertical orientation for the female fitting. Consequently, mounting and removing the towers can be difficult.

It is an object of the present invention to provide a device for mounting towers on boat decks that overcomes the problems described above. It is a further object of the present invention to provide a mounting device that can be adjusted to provide a uniform vertical orientation for a female fitting so that a tower can be easily mounted, removed and reinstalled.

SUMMARY OF THE INVENTION

A device for mounting an above deck structure to a boat deck surface, wherein the above deck structure comprises a plurality of legs for mounting to the boat deck surface, comprising: a first mounting means comprising a top side and a bottom side wherein the bottom side is placed in contact with the boat deck surface; a second mounting means comprising a top side and a bottom side wherein the bottom side is placed in contact with the top side of the first mounting means and can slidingly rotate with respect to the bottom side of the first mounting means so that the top side of the second mounting means will be displaced through a range of angles with respect to a plane of the boat deck surface; a plurality of fittings adapted to receive the legs of the above deck structure and further adapted to receive the top side of second mounting means wherein the fitting can rotate relative to the top side of the second mounting means so that the fitting may be displaced through a range of angles with respect to a centerline of the boat; and means for rigidly attaching the first mounting means, the second mounting means and the fitting to the boat deck surface in a fixed position with respect to each other.

BRIEF DESCRIPTION OF THE DRAWINGS

While this specification concludes with claims particularly pointing out and distinctly claiming that which is regarded as the present invention, the objects and advantages of this invention may be more readily ascertained from the following description of a preferred embodiment when read in conjunction with the accompanying drawings.

DETAILED DESCRIPTION OF THE INVENTION

Figure 1:
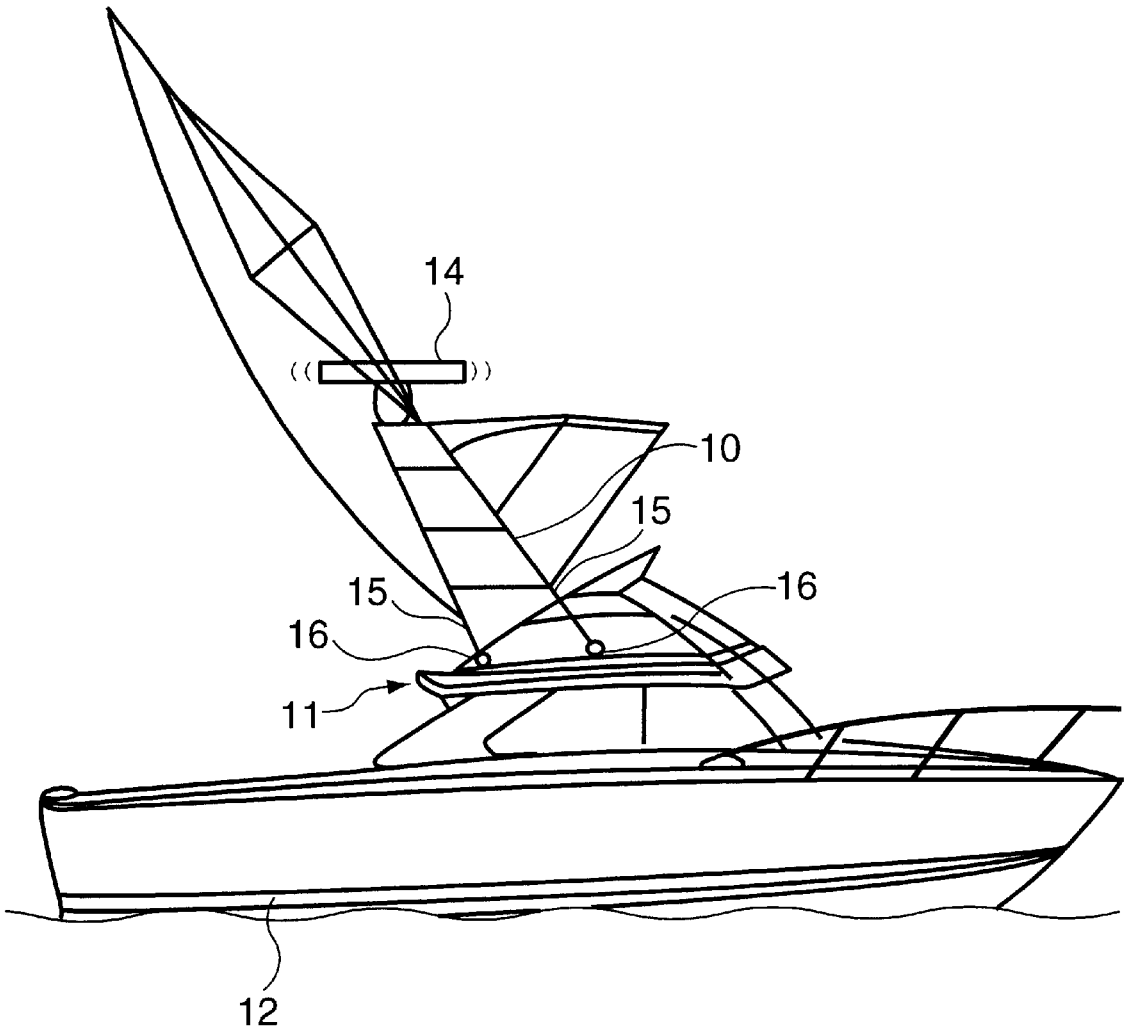
FIG. 1 illustrates of a tower mounted to a boat.

Reference will now be made in detail to the presently preferred embodiment of the present invention. The present invention is directed to a device for mounting towers to the surface of a boat deck. FIG. 1 illustrates a typical tower 10 mounted to the upper deck 11 of a boat 12. The tower 10 illustrated in FIG. 1 is referred to as a radar tower because it is used to mount a radar unit 14. As shown in FIG. 1, the typical tower 10 has a plurality of legs 15 that are typically fabricated from annular metal pipe. The plurality of legs 15 are attached to the deck 11 at a plurality of mounting points 16.

FIG. 1 is set forth herein to illustrate a type of structure with which the present invention may be used. However, neither FIG. 1 nor the description herein should be limited to the particular type of tower 10 illustrated therein nor limited to the mounting of a tower on the upper deck 11. Rather, as is obvious to those of ordinary skill in the art, the present invention can be utilized with any similar structure mounted on any deck location of a boat without departing from the spirit or scope of the present invention.

Figure 2A:
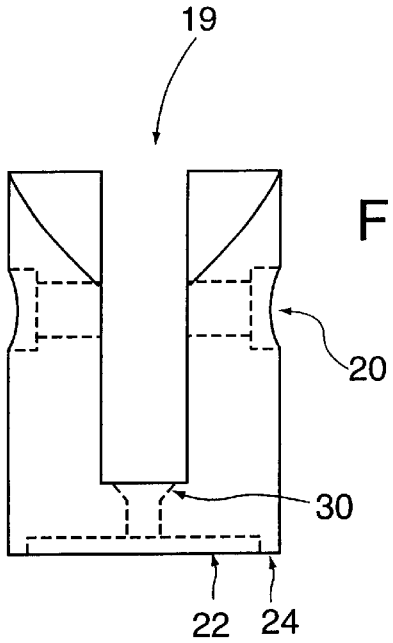
FIGS. 2A, 2B and 2C illustrate the side, front and top view respectively of a fitting for mounting a tower to a boat.
Figure 2B:
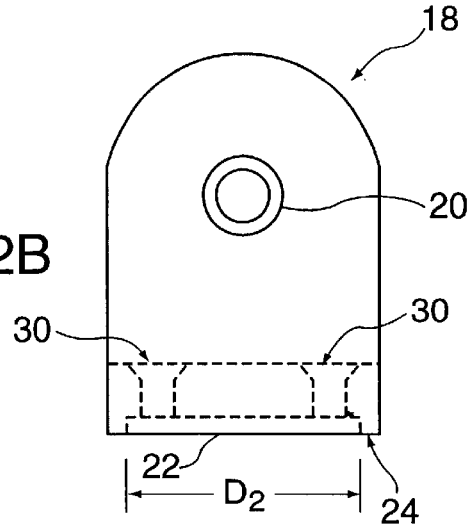
Figure 2C:
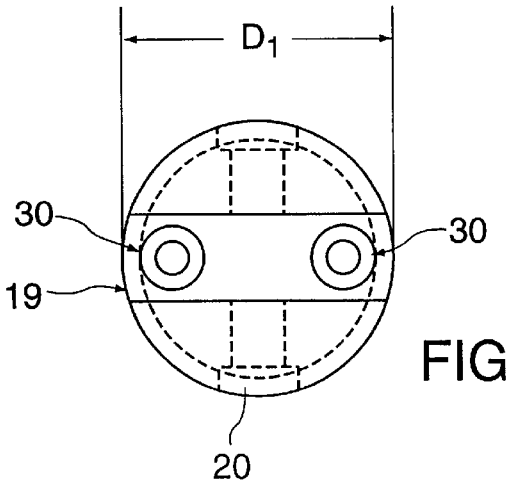
Figure 4:
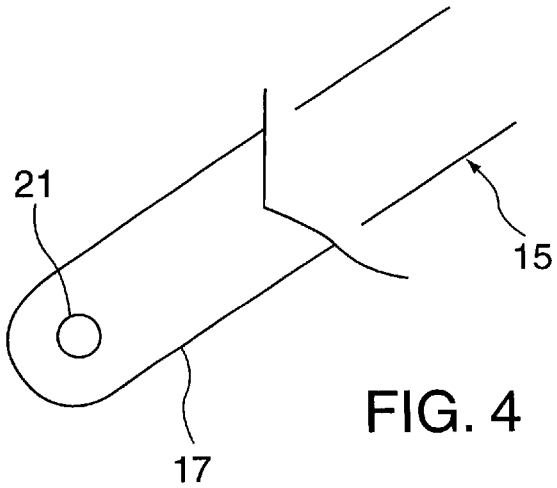
FIG. 4 illustrates a portion of the tower structure.
Figure 5:
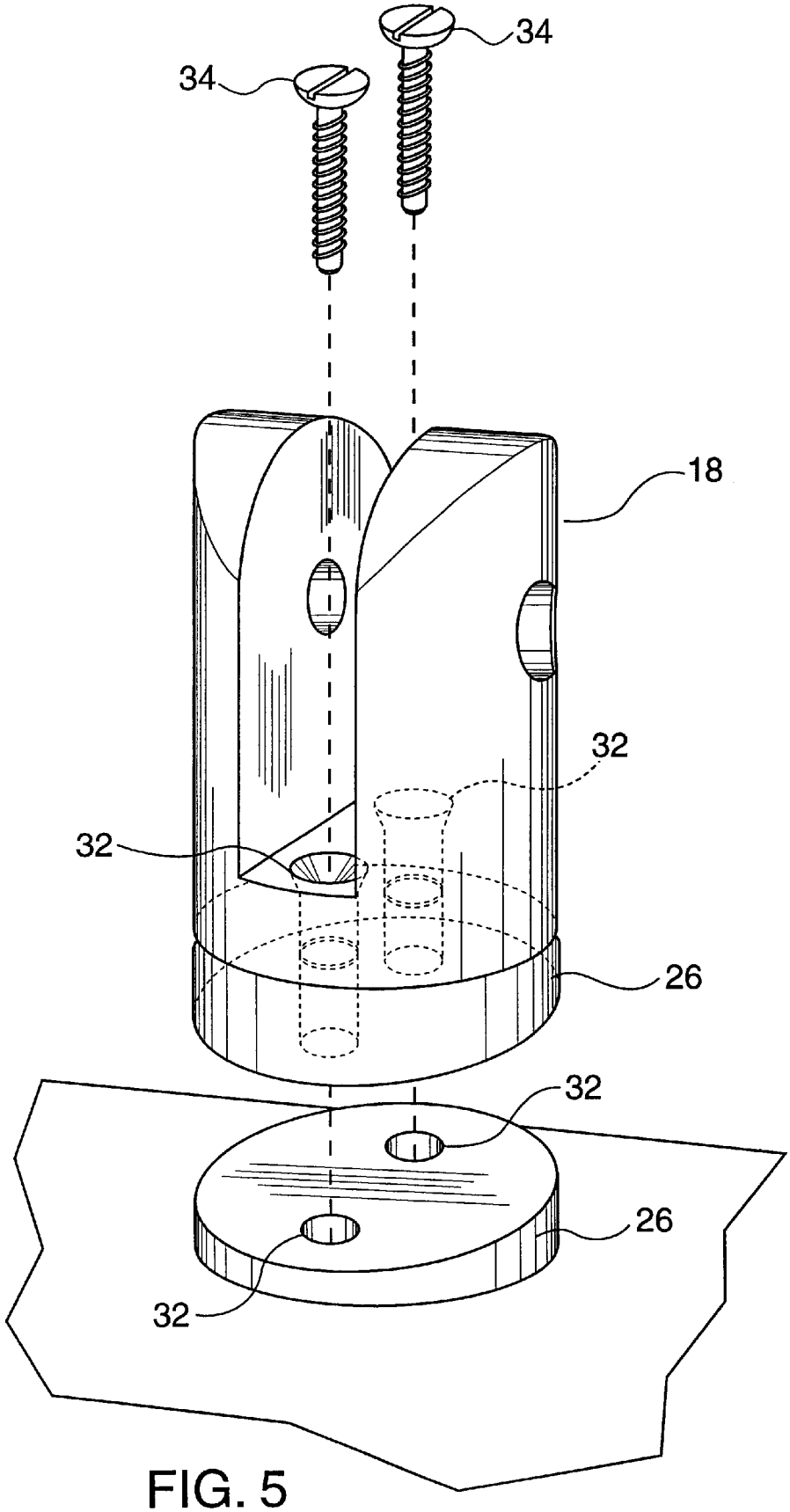
Figure 6:
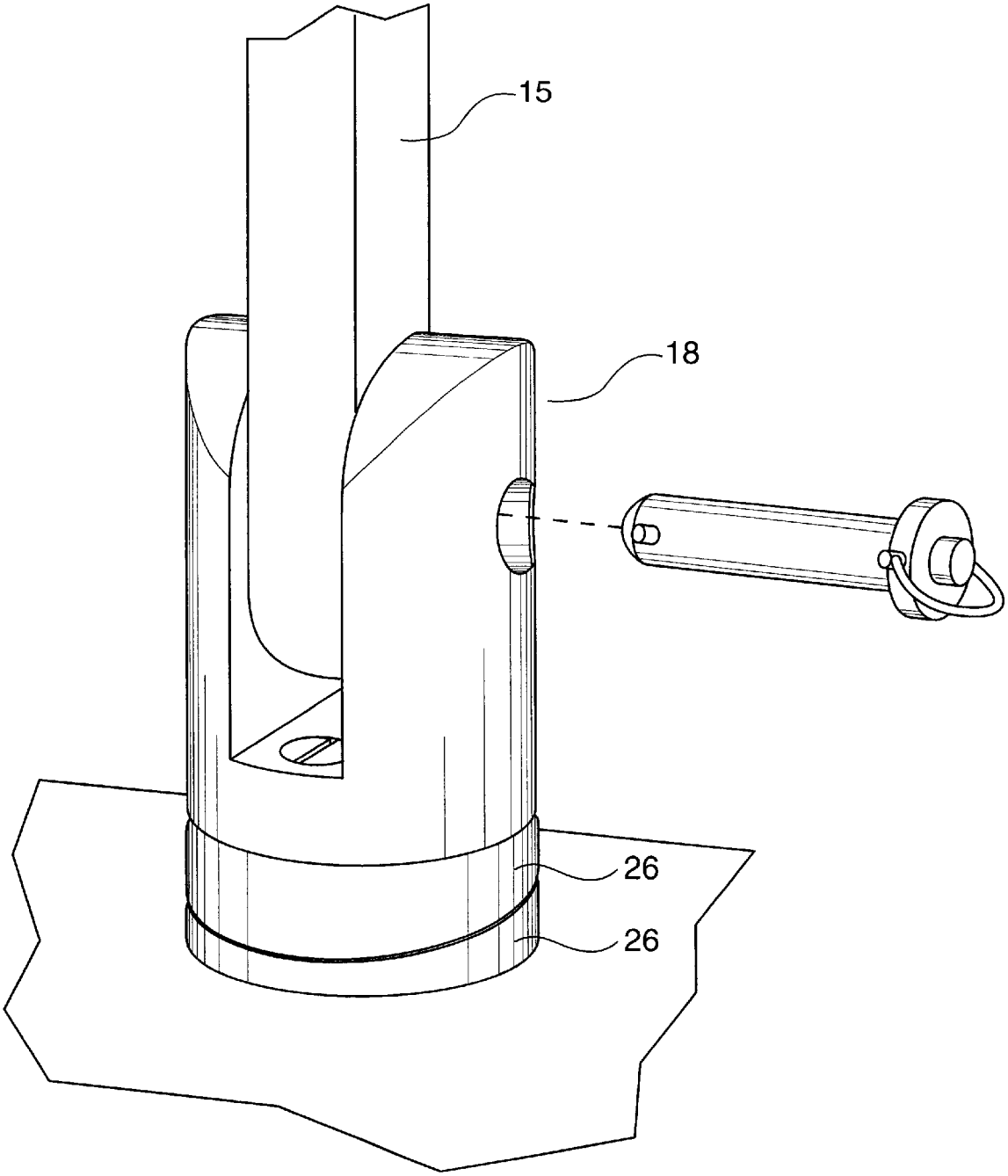

FIGS. 2A, 2B and 2C illustrate perspective views of a fitting 18 that will be mounted to the boat deck 11 at the plurality of mounting points 16. The plurality of legs 15 of the tower 10 typically will each be provided with a foot 17 of generally rectangular cross section. The foot 17 is illustrated in FIG. 4. The foot 17 will be slidingly placed in slot 19 of the fitting 18. The foot 17 will be provided with a through hole 21 that will align with a through hole 20 in fitting 18 when the foot 17 is placed into slot 19. A locking pin as known to those of ordinary skill in the art will be placed through holes 20 and 21 to securely lock tower 10 to the fitting 18 at each of the plurality of mounting points 16. If it is desired to remove the tower 10, each of the locking pins are removed from the holes 20 and 21 and the tower 10 can be removed and replaced if necessary.

The fitting 18 further comprises a machined cylindrical recess 22 in bottom surface 24. The outside diameter of fitting 18 is D while the diameter of the machined cylindrical recess 22 is D2 as illustrated in FIGS. 2B and 2C.

Figure 3A:
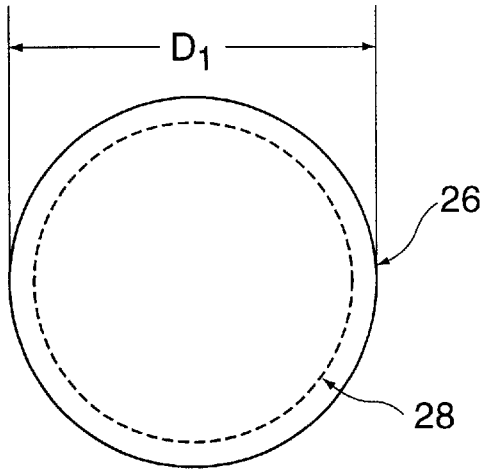
FIGS. 3A and 3B illustrate the top and front views respectively of the preferred embodiment of the mounting device of the present invention.
Figure 3B:
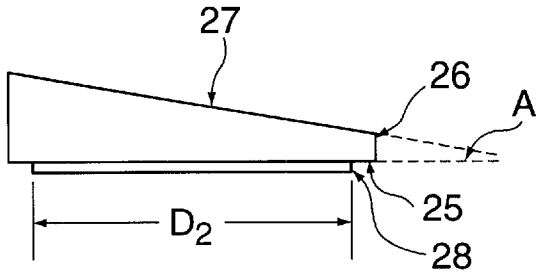

FIGS. 3A and 3B illustrate a mounting device 26. The mounting device 26 is generally a truncated cylinder with outside diameter D1 equal to outside diameter D1 of fitting 18. Mounting device 26 comprises cylindrical protrusion 28 on one surface 25 and a second flat surface 27 not parallel to surface 25. In the presently preferred embodiment of the present invention, second flat surface 27 forms an angle A with respect to surface 25 of approximately 7.5°.

The use of the mounting device 26 to mount a tower 10 to a boat deck 11 will now be described in detail. As described above, a plurality of fittings 18 will be utilized at each of the plurality of mounting points 16 to removeably mount the tower 10 to the boat deck 11. At each of the plurality of mounting points 16, a first mounting device 26 will be placed on the surface of the boat deck 11. The cylindrical protrusion 28 will be placed onto the surface 11 of the boat deck and held temporarily in place by caulking or by other means known to those of ordinary skill in the art. A second mounting device 26 will be placed into the cylindrical recess 22 in fitting 18. In particular, the cylindrical protrusion 28 on the second mounting device 26 will be placed into the cylindrical recess 22. At this point, the fitting 18 may be rotated relative to the second mounting device 26. The second flat surface 27 on second mounting device 26 is then placed on top of the second flat surface 27 on the first mounting device 26.

After placement of the second mounting device 27 and fitting 18 on top of the first mounting device 26, the second mounting device 27 may be rotated relative to the first mounting device 26. By rotating the second mounting device with respect to the first mounting device, an almost infinite range of adjustment of the upper surface 28 of the second mounting device from about 0 to 30° with respect to the boat deck surface 11 is obtained. Further, the fitting 18 may be rotated with respect to mounting devices 26. Rotation of the fitting 18 with respect to the mounting devices 26 accommodates angularity of the mounting surface for the fitting 18 through 360° with respect to the centerline of the boat. When the desired angle of orientation of the fitting 18 is determined through the above described relative rotations, the fitting 18 is affixed to the boat deck 11 as described below.

The fitting 18 comprises a plurality of mounting holes 30 as illustrated in FIGS. 2A, 2B and 2C. When the desired angle of orientation of fitting 18 is determined, the cylindrical protrusion 28 on the second mounting device 26 is marked with the location of the plurality of mounting holes 30. Holes are then drilled at the location of the plurality of mounting holes 30 through the first and second mounting devices 26 and also through the boat deck surface 11. A typical fastening device such as a bolt is then placed through each of the plurality of mounting holes 30, through the holes in the first and second mounting devices 26 and through the deck surface 11. After drilling and placement of the bolt, a nut typically would be placed on the end of the bolt under the deck surface. At the end of this process, the fitting 18 thus would be held rigidly in place at the proper angle of orientation. The process of determining the proper angle of orientation of the fitting 18 by rotating the second mounting device 26 with respect to the first mounting device 26 and also the fitting 18 with respect to the first and second mounting devices 26 is then repeated for each of the plurality of mounting points 16 required for the tower 10. Each of the remaining fittings 18 are then similarly bolted in place to the boat deck 11.

At the end of this process, each of the plurality of mounting points 16 for the tower 10 are provided with a fitting 18 uniformly mounted and oriented so that the tower is easily mounted, removed and/or replaced as described above. Thus, the present invention accomplishes the objective set forth above of solving the problems of prior mounting devices for towers on boat decks with uneven surfaces as well as the other objectives noted above.

The purpose of the above description is to illustrate the presently preferred embodiment of the present invention without implying a limitation therefrom. Those of ordinary skill in the art will recognize that the embodiments just described merely illustrate the principles of the present invention. Many modifications may be made thereto without departing from the spirit and scope of the invention.

What is claimed is:

1. A device for mounting an above deck structure to a boat deck surface, wherein the above deck structure comprises a plurality of legs for mounting to the boat deck surface, and the device is used with each of the plurality of legs whereby the device comprises:

a) a first mounting device comprising a top side and a bottom side wherein the bottom side is placed in contact with the boat deck surface;

b) a second mounting device identical to the first mounting device comprising a top side and a bottom side wherein the bottom side is placed in contact with the top side of the first mounting device and can slidingly rotate with respect to the top side of the first mounting device so that the top side of the second mounting device will be displaced through a range of angles with respect to a plane of the boat deck surface;

c) a fitting adapted to receive one of the plurality of legs of the above deck structure and further adapted to receive the top side of second mounting device wherein the fitting can rotate relative to the top side of the second mounting device so that the fitting may be displaced through a range of angles with respect to a centerline of the boat; and d) means for rigidly attaching the first mounting device, the second mounting device and the fitting to the boat deck surface in a fixed position with respect to each other.

2. The device of claim 1 wherein the first mounting means and the second mounting means each comprise a truncated cylinder with the bottom side offset from the top side by an angle A.

3. The device of claim 2 wherein the angle A is about 7.5 degrees.

4. A device for mounting an above deck structure to a boat deck surface, wherein the above deck structure comprises a plurality of legs for mounting to the boat deck surface, comprising:

a) a first truncated cylinder comprising a top side comprising a first plane and a bottom side comprising a second plane wherein the bottom side is placed in contact with the boat deck surface and first plane is offset from the second plane by an angle A;

b) a second truncated cylinder comprising a top side comprising a first plane and a bottom side comprising a second plane wherein the first plane is offset from the second plane by an angle B, the bottom side is placed in contact with the top side of the first truncated cylinder and can slidingly rotate with respect to thereto, and the top side is adapted to receive a mounting means for one of the plurality of legs.

5. The device of claim 4 wherein the Angle A is about 7.5 degrees and the Angle B is about 7.5 degrees.

6. A method for mounting an above deck structure to boat deck surface, wherein the above deck structure comprises a plurality of legs for mounting to the boat deck surface comprising the steps of:

a) providing a plurality of first mounting means each comprising a top side and a bottom side wherein each bottom side is placed in contact with the boat deck surface;

b) providing a plurality of second mounting means each comprising a top side and a bottom side wherein each bottom side is placed in contact with the top side of the corresponding first mounting means and can slidingly rotate with respect to the first mounting means c) rotating the top side of each second mounting means and thereby displacing each second mounting means through a range of angles with respect to a plane of the boat deck surface until a proper orientation is determined;

d) providing a plurality of fittings each adapted to receive one of the plurality of legs of the above deck structure and further adapted to rotatingly receive the corresponding top side of one of the second mounting means;

e) rotating each fitting relative to the top side of the second mounting means so that the fitting may be displaced through a range of angles with respect to a centerline of the boat; and f) rigidly attaching the first mounting means, the second mounting means and the fitting to the boat deck surface in a fixed position with respect to each other after step a and step e are performed.

* * * * *